US006745487B1

(12) United States Patent
Nield

(10) Patent No.: US 6,745,487 B1
(45) Date of Patent: Jun. 8, 2004

(54) DOWNHOLE CABLE LENGTH MEASURING APPARATUS

(76) Inventor: Barry J. Nield, 20 Pinckney St., Greenville, SC (US) 29601

( * ) Notice: Subject to any disclaimer, the term of this patent is extended or adjusted under 35 U.S.C. 154(b) by 0 days.

(21) Appl. No.: 10/407,884

(22) Filed: Apr. 4, 2003

Related U.S. Application Data

(60) Provisional application No. 60/448,655, filed on Feb. 18, 2003.

(51) Int. Cl.[7] ..... G01B 3/12
(52) U.S. Cl. ..... 33/735
(58) Field of Search ..... 33/1 PT, 302, 33/732, 734–749; 242/563

(56) References Cited

U.S. PATENT DOCUMENTS 1,700,336 A * 1/1929 Redfield ..... 33/747
2,809,436 A * 10/1957 Worthington et. al. ..... 33/737
2,981,102 A * 4/1961 Melton ..... 33/748
3,027,649 A * 4/1962 Sloan ..... 73/152.02
3,068,579 A * 12/1962 Newman ..... 33/736
3,520,062 A * 7/1970 Tanguy ..... 33/734
3,753,294 A * 8/1973 Attali et al. ..... 33/735
4,058,266 A * 11/1977 Beery ..... 33/732
4,117,600 A * 10/1978 Guignard et al. ..... 33/735
4,400,882 A * 8/1983 Thornton ..... 33/732
4,570,348 A * 2/1986 Amsler et al. ..... 33/734
4,779,201 A * 10/1988 Iizuka et al. ..... 73/152.02
5,062,048 A * 10/1991 Coulter et al. ..... 73/152.02
5,245,760 A * 9/1993 Smart et al. ..... 33/735
5,351,531 A * 10/1994 Kerr ..... 33/734
5,430,665 A * 7/1995 Jin et al. ..... 33/735
6,588,696 B1 * 7/2003 Riihela et al. ..... 242/563.2

* cited by examiner

*Primary Examiner*—G. Bradley Bennett

(57) ABSTRACT

A wireline cable length measuring apparatus tracks the length and other parameters of a wireline cable in a well bore. The apparatus has three major components: a rotational distance measuring assembly; a rotation-to-length (rotation:length) calibration assembly; and a processor unit. The rotational distance measuring assembly engages the wireline cable in a manner similar to a standard wireline count wheel, typically receiving the cable from a draw works or a wireline service truck. The rotational distance measuring assembly has a rotation sensor which generates a rotation signal in response to the paying-out and reeling-in of the cable over the count wheel. The rotation:length calibration assembly also engages the wireline cable. However, the rotation:length calibration assembly only intermittently engages the wireline cable, and therefore is subject to substantially less wear than the counter wheel. The rotation:length calibration assembly has a length sensor which generates a length calibration signal in response to the length of the cable in passing through the rotation:length calibration assembly. The length calibration signal is used by the processor to convert rotations of the counter wheel into calibrated length measurements. The processor component receives and processes the sensor signals generated by the other components of the apparatus and provides processor output signals relating to the length and other parameters of the cable passing through the apparatus and into the well bore. The processor unit includes a CPU which accomplishes the processing function of the present apparatus.

14 Claims, 4 Drawing Sheets

DOWNHOLE CABLE LENGTH MEASURING APPARATUS

The present application claims the benefit of prior filed provisional patent application, Ser. No. 60/448,655, filed Feb. 12, 2003 to which the present application is a regular U.S. national application.

FIELD OF THE INVENTION

The present invention is in the field of geometrical instruments with a central processing unit for making measurements in a well borehole environment. More specifically, the present invention relates to, measurement apparatuses having a rolling contact borne on by a flexible material being measured, the contact caused to rotate by the relative movement between the contact and the material; and having a CPU system for performing the geometric calculation to yield a corrected length measurement.

BACKGROUND OF THE INVENTION

Logging operations in oil and gas wells require accurate determination of the location of the logging tool in the borehole of the well. Various strategies have been developed to accomplish the accurate location determination of the logging tool during logging operations. One of these strategies involves monitoring the length of the cable or wireline supporting the logging tool payed into or reeled out of the well bore by the cable draw works. Then the downhole length of the cable is used to determine the location of the logging tool in the borehole during the logging operation. "Count wheel" or "counter wheel" systems are an example of a technology using this strategy to monitor the length of cable payed into a well bore from a logging tool draw works.

A specific example of a counter wheel type depth measurement system for wireline is disclosed in Kerr, U.S. Pat. No. 5,351,531. Counter wheel systems similar to that disclosed in Kerr typically rely on the use of at least one specifically calibrated count wheel which is matched precisely to the diameter of the wireline or cable loaded onto the cable drum/reel of the draw works to generate a distance of travel signal for the length of cable payed out or reeled in. However, if the operator of the draw works is required to change the cable supply reel or otherwise alter the size/diameter of the cable or wireline used in the draw works, the counter wheel must also be changed out to provide a counter wheel matched to the specific size/diameter of changed cable. Additionally, counter wheels are precision components and subject to replacement upon excess wear, as wearing of the counter wheel will adversely affect the accuracy of the cable length measurement. The matched counter wheel is required in such systems as Kerr because the distance of travel signal in Kerr relates to the length of the surface of the cable engaged with the count wheel, which mathematically is a function of the radius of the count wheel to its wheel surface. However, the distance of travel signal indicating count wheel surface travel does not relate to the true (or mean) length of the cable passing through the device. To relate to the true length of the cable passing through a count wheel type measuring assembly, the count wheel's distance of travel signal must be corrected for the diameter of the specific cable engaged in the measuring assembly. Previously in the field, this correction was provided by using a count wheel matched to the size of cable/wireline loaded into the draw works. However, having to match the count wheel to the cable necessitates changing the count wheel whenever the size of the cable is changed.

Although the measurement system of Kerr and related devices may be useful for their intended purpose, it would be beneficial in the field to have an alternative measurement apparatus that did not require changing out the count wheel whenever the diameter of the cable was changed. Additionally, in wireline measurement systems like that of Kerr, where a full loop of the cable is engaged on the count wheel, the count wheel is always in use, causing continuous wear on a component of the system which directly impacts the system's measurement accuracy. It would be further beneficial to the field to have an alternative measurement apparatus in which the high precision measurement component could be readily disengaged from the cable without otherwise interfering with operation of the draw works.

SUMMARY OF THE INVENTION

The present invention is an apparatus useful for determining the length of a cable downhole in a well bore, e.g., a wireline cable used in a hydrocarbon well logging operation. The present downhole cable length measuring apparatus can be practiced with standard wireline cable draw works as are typically used on drilling rigs for well logging operations. The downhole cable length measuring apparatus is disposed between the cable drum or reel of the draw works and the well bore.

The downhole cable length measuring apparatus comprises three major components: a rotational distance measuring assembly; a rotation-to-length (rotation:length) calibration assembly; and a processor unit.

- The rotational distance measuring assembly component is disposed in engagement with the wireline cable, and typically receives the cable from a draw works or a wireline service truck. The rotational distance measuring assembly has a rotation sensor which generates a rotational distance signal in response to movement (the paying-out and reeling-in) of the wireline cable.
- The rotation:length calibration assembly component also engages the wireline or cable, typically more proximate the well bore relative to the length measuring assembly. However, the rotation:length calibration assembly only intermittently engages the wireline cable, and therefore is subject to substantially less wear than the counter wheel. The rotation:length calibration assembly has a length sensor which generates a length calibration signal in response to the length of the cable in passing through the rotation:length calibration assembly.
- The processor component receives and processes the sensor signals generated by the other components of the apparatus to provide at least one processor output signal relating the length of wireline cable passing through the apparatus and downhole in the well bore. The processor unit includes a CPU which accomplishes the processing function of the present apparatus.

It is an object of the present invention to provide a downhole cable length measuring apparatus wherein the cable length measurement can be determined independent of the apparatus' counter wheel circumference or the diameter of the cable or wireline engaged in the apparatus.

DETAILED DESCRIPTION OF THE INVENTION

Figure 1:
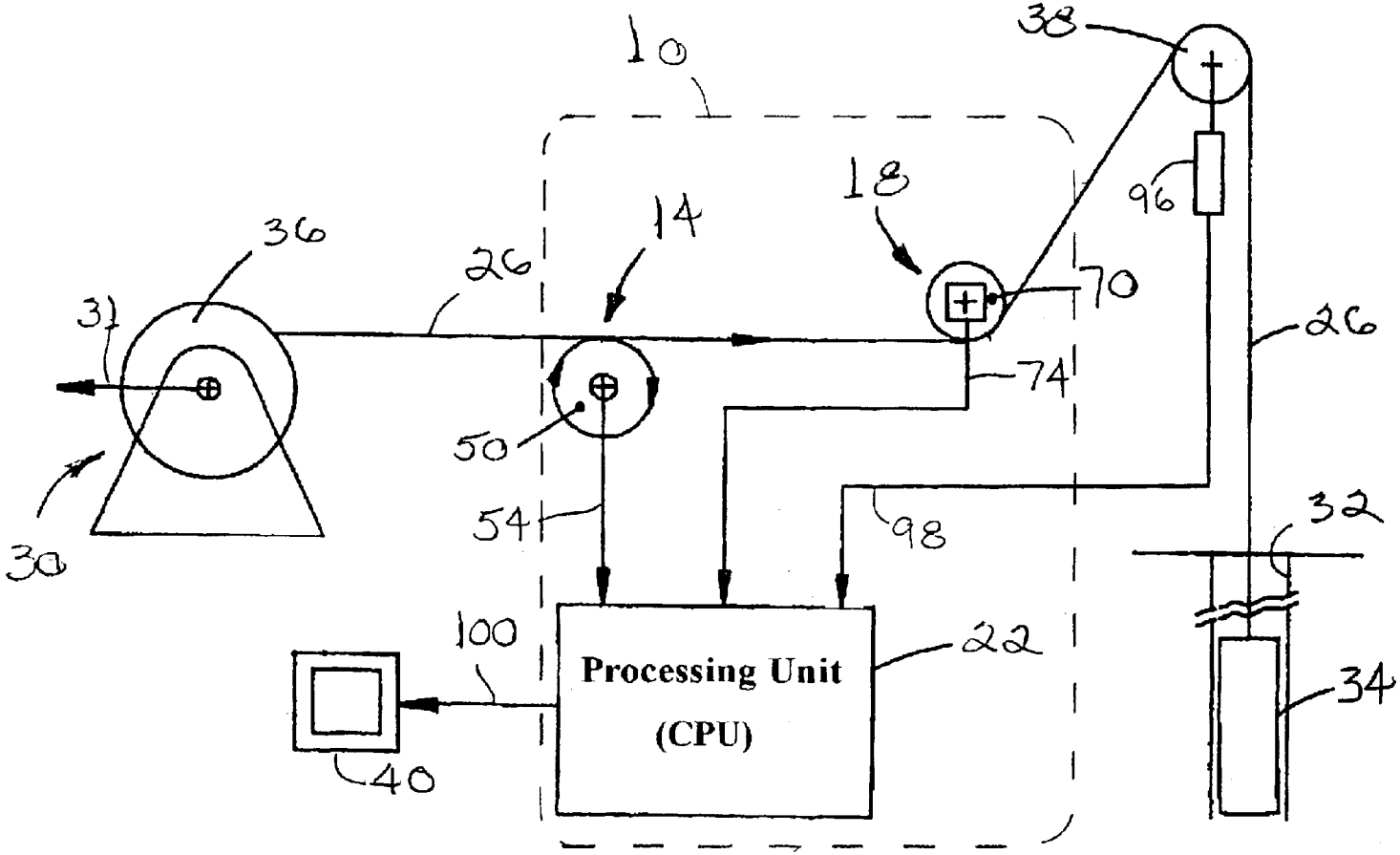
FIG. 1 is a schematic representation of the present downhole cable length measuring apparatus for determining the downhole length of a wireline or cable in a well bore.

Referring now to the drawings, the details of preferred embodiments of the present invention are graphically and schematically illustrated. Like elements in the drawings are represented by like numbers, and any similar elements are represented by like numbers with a different lower case letter suffix.

As exemplified in FIG. 1, the present invention is a downhole cable length measuring apparatus 10 for measuring the length of a cable or wireline 26 as it is payed into or reeled out of a well bore. The downhole cable length measuring apparatus 10 comprises three major components: a rotational distance measuring assembly 14; a rotation-:length calibration assembly 18 and a CPU based processor unit 22 Typically, the present downhole cable length measuring apparatus 10 is disposed between a cable draw works 30 and the well bore 32 of a well, and is useful for determining the downhole distance location of a tool 34, such as a logging tool attached to the downhole end of the cable 26. The draw works 30 is controlled by the usual draw works signals 31. The CPU 22 processes the downhole distance/location of the tool 34, and other information as desired, for display on a console 40. The console 40 serves as an input/output or user interface means for the present cable length measuring apparatus 10. The console 40 is known and used in the field and as the user interface for devices such as the present invention.

Figure 2:
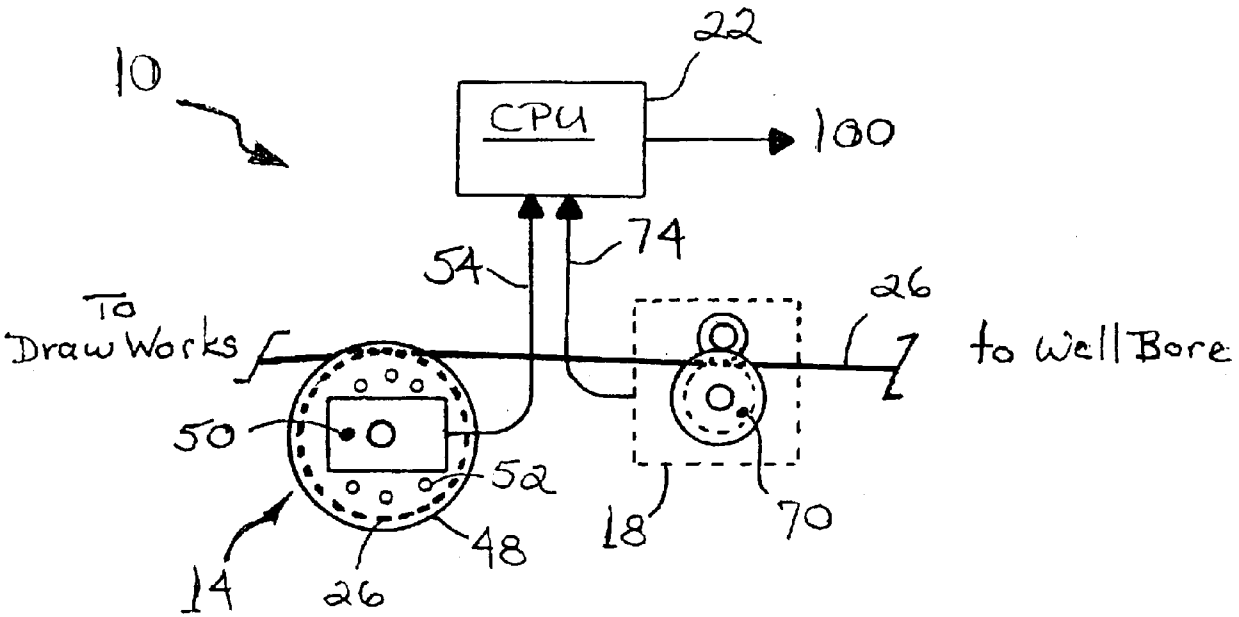
FIG. 2 is an alternate schematic representation of the present downhole cable length measuring apparatus.

As illustrated in FIG. 2, the rotational distance measuring assembly component 14 is disposed in engagement with the wireline cable 26. The rotational distance measuring assembly 14 has a rotation sensor 50 which generates a rotational distance signal 54 in response to movement (the paying-out and reeling-in) of the wireline cable 26. The rotation:length calibration assembly component 18 also engages the wireline cable 26 and has a length sensor 70 which generates a calibration signal 74 in response to the length of the cable 26 passing through the rotation:length calibration assembly 18. The processor component 22 receives and processes the rotational distance signal 54, the calibration signal 74 and any other sensor signals 98 (e.g., a load signal) generated by other components 96 (e.g., a load sensor) internal and/or external to the apparatus 10 to provide at least one processor output signal 100 relating the length of wireline cable 26 passing through the apparatus 10 and downhole into the well bore 32.

The rotational distance measuring assembly component 14 of the present downhole cable length measuring apparatus 10 may be accomplished by any of a number of counter wheel means known to one of ordinary skill in the art which can be adapted to use the counter wheel 48 of the means to sense and generate a sufficiently accurate and precise signal 54 indicating the rotational distance (degree of rotation) of the count wheel 48. This rotational distance signal 54 relates to the degree of rotation imparted to the count wheel 48 by movement of the cable 26 in its rolling engagement with the count wheel 48.

Figure 3:
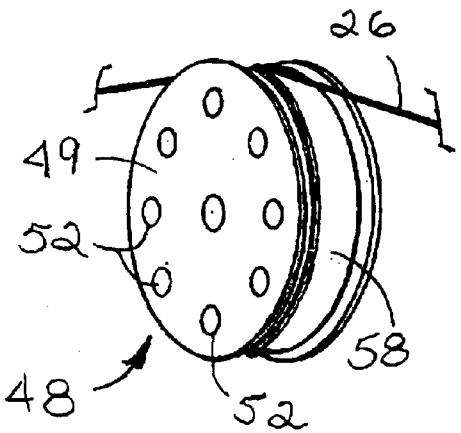
FIG. 3 is a perspective drawing of a count/counter wheel having a complete loop of cable or wireline engaged on the circumferential surface of the count wheel.

As shown in FIG.3, the rotational distance measuring assembly 14 includes at least one rotatable count wheel 48. The count wheel 48 has a circumferential wheel surface 58 at least a portion of which directly engages the wireline cable 26. By bearing on the count wheel surface 58, the cable 26 causes the count wheel 48 to rotate by the relative movement between the cable 26 and the count wheel 48 as the cable 26 is payed-out or reeled-in by the draw works 30.

The wheel surface 58 has a relatively fixed circumferential distance, which distance is a function of the radius of the count wheel 48 from its axis to its circumferential surface. In a preferred embodiment, the rotating count wheel 48 was engaged by a full loop of the cable 26. By encircling the circumferential wheel surface 58, the loop of cable 26 had a length substantially equal the circumferential distance of the count wheel surface 58. Because the cable 26 and count wheel (or wheels) 48 are in continuous rolling contact, the wheel surface 58 is subject to wear. This wear shortens the radius of the count wheel 48 and reduces the circumferential distance of the wheel surface 58. However, in the present invention, the radius of the count wheel 48 is not a factor in calculating cable length, therefore, changes in the radius of the count wheel 48—or in the diameter of the engaged cable 26—does not effect the cable length determination of the present apparatus 10. Thus, the cable length determination of the present apparatus is not affected by the wear on the count wheel 48. In this manner, the object of the present invention of providing a downhole cable length measuring apparatus 10 that avoids the need to have the count wheel 48 matched to the diameter of the cable 26 being measured is accomplished.

The rotational distance measuring assembly 14 includes a rotation sensor 50 which detects degree and direction of rotation of the count wheel(s) 48. The rotation sensor generates rotational distance signals 54 in response to the degree of rotation of the count wheel 48. The rotational distance signals 54 are communicated to the processor unit 22 for further processing. Rotation sensors 50 practicable in the present invention are known to and adaptable by one of ordinary skill in the art for use in the present rotational distance measuring assembly 14. Applicable rotation sensor units are selectable from the group consisting of mechanical, electrical and electro-mechanical rotation sensors (see U.S. Pat. Nos. 3,027,649; 3,753,294; and 4,117,600), photoelectric rotation sensor units, magnetic rotation sensor units and servo-electric rotation sensor units, and other means known to one of skill in the art.

In an exemplary embodiment, the present invention utilized a photoelectric type rotation sensor 50 in the rotational distance measuring assembly 14. The photoelectric rotation sensor 50 was disposed proximate a face of the count wheel 48 such that a series of spaced targets 52 on the count wheel face 49 impinge on the photo sensor 50 upon rotation of the count wheel 48. See FIGS. 2 and 3. As the movement of the cable 26 passing over the counter wheel surface 58 turned the counter wheel 48, the targets 52 rotated past and impinged on the photo sensor 50. The targets 52 impinging on the photo sensor 50 caused the rotational distance measuring assembly 14 to generate rotational distance signals 54 corresponding to the angular distance, direction and rate of rotation of the count wheel 48. These rotational signals 54 were then communicated to the processing unit 22.

Figure 4:
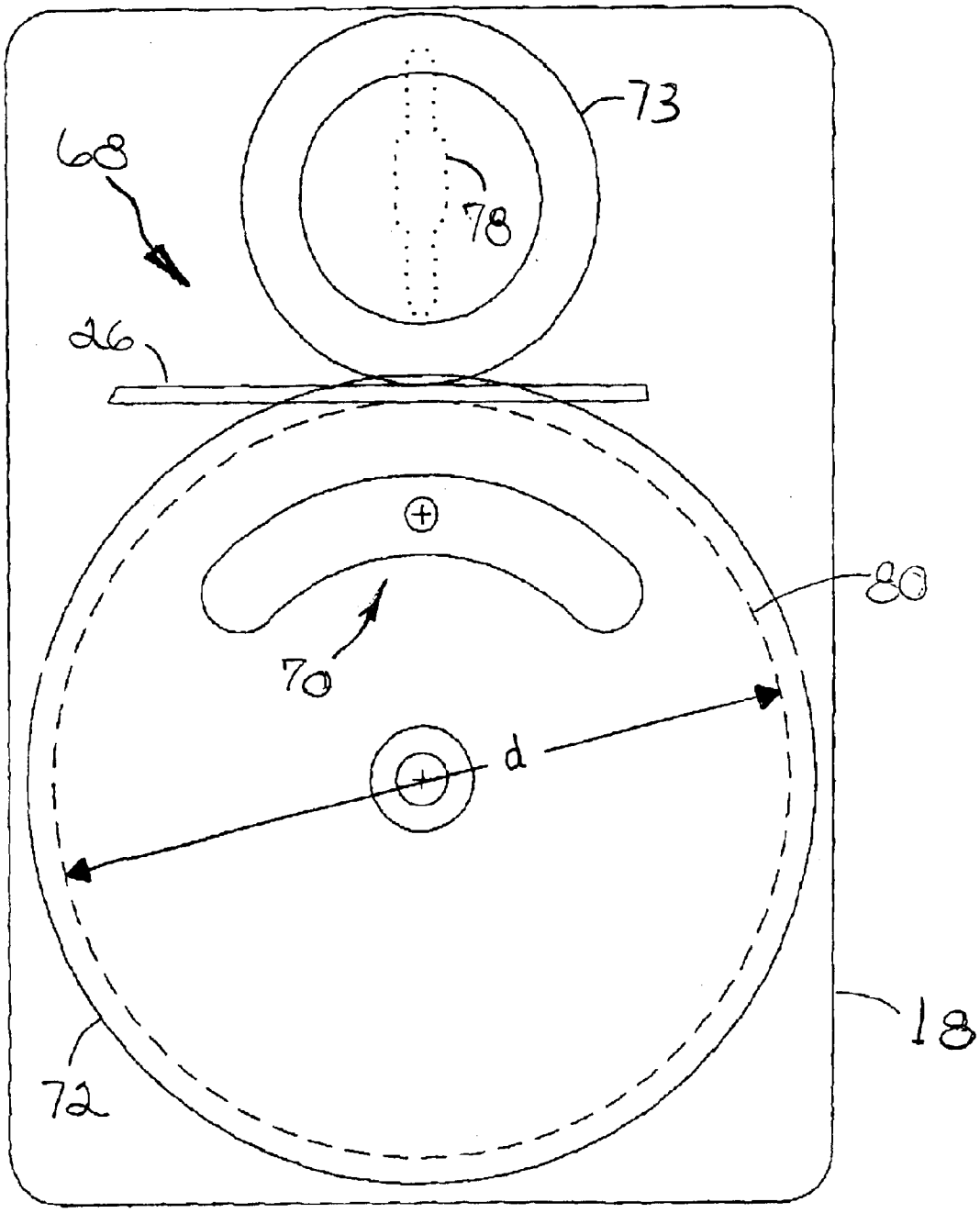
FIG. 4 is a schematic representation of a rotation distance calibration assembly, illustrating the relationship between the wireline cable and the index and tensioning wheels.

As illustrated in FIG. 4, the rotation:length calibration assembly 18 of the present downhole cable length measuring apparatus 10 further comprises a length sensor 70, and an index wheel assembly 68 which releasably engages the wireline cable 26. In a preferred embodiment, the index wheel assembly 68 comprised two wheels disposed in opposition: an index wheel 72 and a tensioning wheel 73. In this embodiment, the index wheel 72 was fixed relative to the tensioning wheel 73, with the tensioning wheel 73 displaceable relative to the index wheel 72 by the diameter of the cable 26 engaged between it and the index wheel 72. In this manner, the index wheel assembly 68 can accommodate cables of different diameters. However, as known to the skilled artisan, the tensioning wheel 73 could have been practiced as fixed and the index wheel 72 as displaceable.

The wireline cable 26 was engaged in rolling contact between the index wheel 72 and the tensioning wheel 73 by means of a tensioning wheel bias assembly 78. This was accomplished by the tensioning wheel 73, which included a bias assembly 78 for holding the tensioning wheel 73 in forced contact with the cable 26. This in turn held the cable 26 in close frictional engagement with the index wheel 72. An important feature of the index wheel assembly 68 is that it is releasable from its engagement with the cable 26. This was accomplished by overcoming the bias force of the bias assembly 78 and removing the cable 26 from between the index wheel 72 and tensioning wheel 73.

Figure 5:
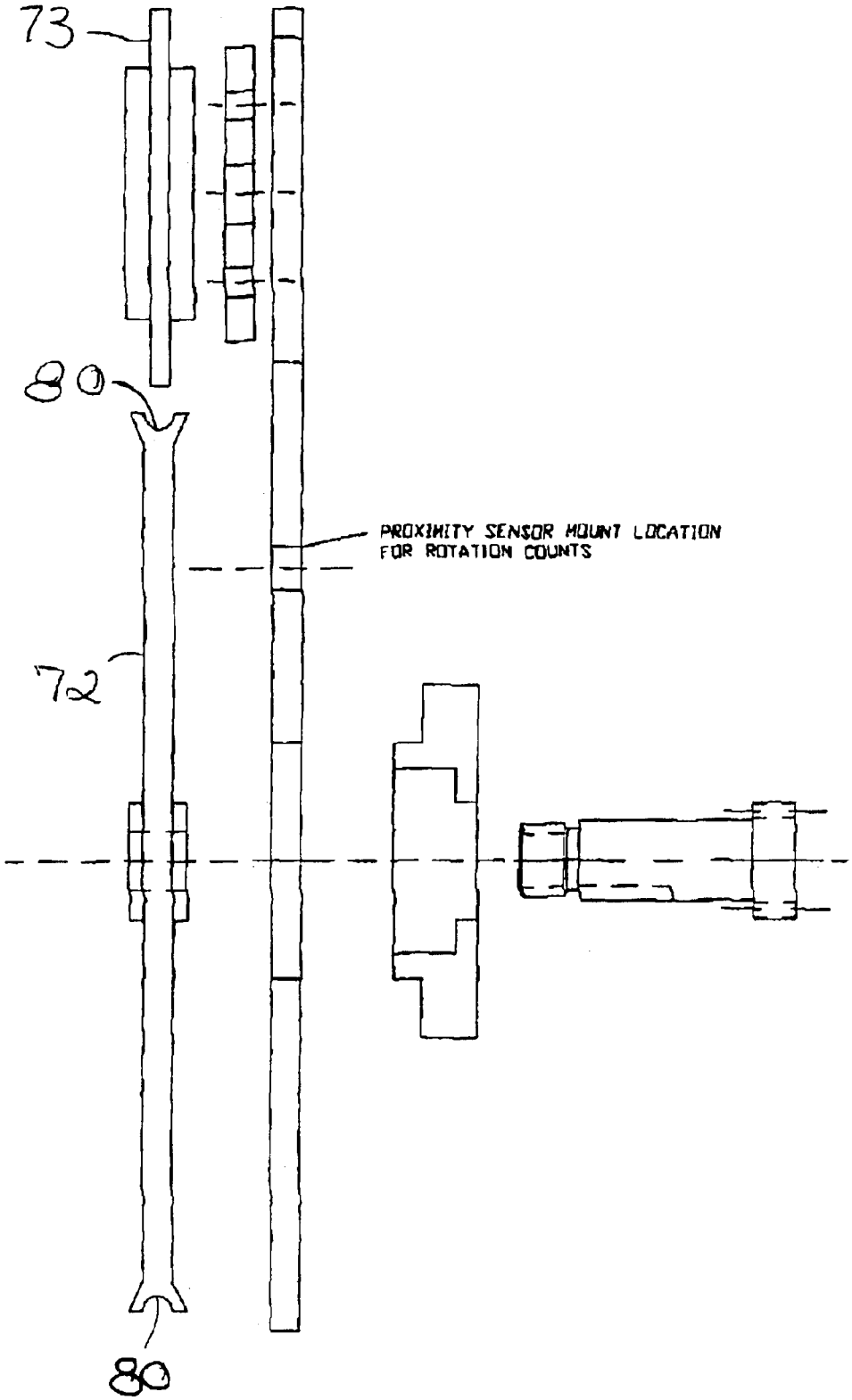
FIG. 5 is a partial cross-sectional view of an index wheel assembly illustrating the relationship between the index wheel and the tensioning wheel when the two wheels are disengaged to release or to insert a wireline cable from or into the assembly.

The index wheel 72 is a precision component having an index surface 80 engaged in rolling contact with the cable 26 (also see FIG. 5). The index surface 80 has a precise fixed and known circumferential distance determined by the formula: $\pi d$ where d is the diameter of the index surface 80 and $\pi$ is the mathematical constant Pi. Therefore, every rotation of the index wheel 72 passes a known length of cable 26 through the index wheel assembly 68.

The index wheel assembly 68 includes a length sensor assembly 70 for indicating a complete rotation of the index wheel 72, and concomitantly, indicating when a discrete length of cable 26 equal to the circumference of the index surface 80 has passed through the assembly 68. The length sensor 70 can be accomplished using a switch that makes contact at each completed revolution of the index wheel 72. Alternatively, the rotations sensors noted above are adaptable by one of ordinary skill in the art for practice in the index wheel assembly 68 as a length sensor 70. The length sensor 70 sends a calibration signal 74 (e.g., closure of the switch contact) to the processor unit 22 indicating a complete rotation of the index wheel 72 and the passage of a discrete length of the engaged wireline cable 26 passing through the assembly 68. In this manner, the length sensor assembly 70 senses discrete lengths of the cable 26 with which it is in rolling engagement and generates a length calibration signal corresponding to the sensed discrete length of the cable 26.

The index wheel assembly 68 sends a calibration signal 74 to the processor unit 22 each time a complete revolution of the index wheel 72 occurred. At the processor unit 22, the count wheel signals 54 generated by the rotation of the count wheel 48 are converted to number of units of distance traveled by the cable 26 at the count wheel 48 by converting count wheel rotations to cable length. The conversion is accomplished by equating the degree of rotation of the count wheel 48 derived from the number of rotation signal pulses to one or more whole rotations of the index wheel 72. In this manner, the number of degree of rotation signal pulses generated by the rotation assembly 14 that occur during a whole rotation of the index wheel 72 equals the specific circumference length of the index wheel 72. Thus count wheel pulses are calibrated as length of cable 26 passing through the apparatus 10.

CPU based processing units practicable in the present invention are known in the field and adaptable by one of ordinary skill in the art. For example see Kerr, U.S. Pat. No. 5,351,531, where two CPU's are utilized. The first CPU is used for processing input data to obtain periodic measurements of tension and corrected depth and the second CPU for determining line speed and other processes. Another example is Coulter, U.S. Pat. No. 5,062,048, where pulses from encoder wheels are corrected for depth and the data inputted into a CPU for processing and conversion. Further, in Iizuka, et al., U.S. Pat. No. 4,779,201, a data processing control means receives and processes electric signals and observation position information.

Load sensors (transducers) for the purpose of the present invention are devices which measure mass/weight on the wire line cable 26 proximate the rotation distance calibration assembly 18 before the cable 26 enters the well bore 32. Load sensors are an example of a source of another signal 98 that could be sent to the processor unit 22 from an external device 96. Load sensors practicable in the present invention are known in the field and adaptable for use in the present invention by one of ordinary skill in the art. For example, Kerr, U.S. Pat. No. 5,351,531 describes a tension load cell which provides an analog signal representative of the tension in a slickline. Coulter, U.S. Pat. No. 5,062,048, also relates a tension measuring device which is used to measure tension at the wellhead by contacting the wireline. In each of these devices, the signal is sent to a processor/CPU for conversion into a representative value useful for the purpose of the respective device.

The processor unit 22 can be programed to provide a variety of output signals 100 derived from the different sensor signals it receives. These output signals 100 can convey data relating to a number of different parameters of the wireline cable passing through the apparatus. In addition to various length parameters (e.g., actual length, downhole depth, relative length, etc.), other parameters such as cable speed, cable loading, cable direction and other parameters can be programed to be output from the processor unit 22 by the ordinary skilled artisan. Additionally, the output signals 100 can be used to drive any of a variety of readouts, displays and control circuits (such as an automatic braking circuit for a draw works controller).

While the above description contains many specifics, these should not be construed as limitations on the scope of the invention, but rather as exemplifications of one or another preferred embodiment thereof. Many other variations are possible, which would be obvious to one skilled in the art. Accordingly, the scope of the invention should be determined by the scope of the appended claims and their equivalents, and not just by the embodiments.

What is claimed is:

1. A downhole cable length measuring apparatus for determining the downhole length of a wireline cable in a well bore comprising:

a rotational distance measuring assembly engaging the wireline cable, the rotational distance measuring assembly having a rotation sensor which generates a rotational distance signal in response to movement of the wireline cable;

a rotation:length calibration assembly engaging the wireline cable and having a length sensor which generates a cable length signal in response to passage of a length of the engaged cable through the calibration assembly; and a processor for receiving and processing sensor signals and providing at least one processor output signal relating the length of wireline cable passing through the apparatus to the downhole length of the wireline cable in the well bore.

2. The cable length measuring apparatus of claim 1, wherein the rotational distance measuring assembly further comprises:

a rotating count wheel having a circumferential wheel surface directly engaging a portion of the wireline cable, and the count wheel rotating in response to linear movement of the wireline cable; and a rotation sensor communicating with the count wheel, the rotation sensor detecting rotation of the count wheel and generating a rotational distance signal in response to a length of wireline cable moving over the circumferential surface of the count wheel.

3. The cable length measuring apparatus of claim 1, wherein the rotation:length calibration assembly further comprises an index wheel assembly engaging the wireline cable and having a cable length sensor determining a length of the engaged wireline cable passing through the calibration assembly per rotation of an index wheel and generating the cable length signal in response to the rotation of the index wheel caused by passage of the engaged cable.

4. The cable length measuring apparatus of claim 1, further comprising a load transducer engaging the wireline cable and providing a load sensor signal relating to a weight load on the wireline cable.

5. The cable length measuring apparatus of claim 4, wherein the load transducer engaging the wireline cable provides a load sensor signal relating to the weight load on the wireline cable at the rotation:length calibration assembly.

6. The rotating count wheel of claim 2, wherein the engaged portion of the wireline cable is a loop of the cable encircling the circumferential wheel surface, the loop of cable having a length substantially equal the circumferential distance of the count wheel.

7. The rotation sensor of claim 2, further comprising a rotation sensor for detecting rotation of the count wheel, and generating and sending the rotational distance signal to the processor.

8. The rotation sensor of claim 7, wherein the rotation sensor is selected from the group consisting of a photoelectric rotation sensor, a magnetic rotation sensor and a servo-electric rotation sensor.

9. The downhole cable length measuring apparatus of claim 1, wherein the rotational distance measuring assembly receives the wireline cable from a cable reel device.

10. The downhole cable length measuring apparatus of claim 1, wherein the processor for receiving and processing sensor signals further comprises a computer CPU.

11. The downhole cable length measuring apparatus of claim 1, wherein the processor for receiving and processing sensor signals provides at least one additional processor output signal relating a parameter of the wireline cable passing through the apparatus.

12. The downhole cable length measuring apparatus of claim 1, wherein the processor for receiving and processing sensor signals provides at least one additional processor output signal relating a parameter of the wireline cable passing through the apparatus, the parameter selected from the group consisting of: cable speed, cable load and cable direction.

13. The downhole cable length measuring apparatus of claim 1, wherein the processor for receiving and processing sensor signals provides the processor output signal to a display circuit.

14. The downhole cable length measuring apparatus of claim 1, wherein the processor for receiving and processing sensor signals provides the processor output signal to draw works control circuit.

* * * * *